US007268324B2

(12) United States Patent
Liebold et al.

(10) Patent No.: US 7,268,324 B2
(45) Date of Patent: Sep. 11, 2007

(54) ELECTRIC COOKING ASSEMBLY WITH HOT-WARNING INDICATOR

(75) Inventors: Frederick Liebold, Maynardville, TN (US); Kim Lezatte, Harriman, TN (US)

(73) Assignee: Ceramaspeed Limited (GB)

( * ) Notice: Subject to any disclaimer, the term of this patent is extended or adjusted under 35 U.S.C. 154(b) by 0 days.

(21) Appl. No.: 11/170,253

(22) Filed: Jun. 29, 2005

(65) Prior Publication Data

US 2007/0000909 A1 Jan. 4, 2007

(51) Int. Cl.
*H05B 1/02* (2006.01)

(52) U.S. Cl. ..... 219/506; 219/497; 219/412; 219/483; 219/445.1; 307/39

(58) Field of Classification Search ..... 219/497, 219/495, 494, 506, 412–414, 483–487, 481, 219/445.1, 448.15, 448.16, 448.18, 448.17; 307/39–41

See application file for complete search history.

(56) References Cited

U.S. PATENT DOCUMENTS

| | | | | |
|---|---|---|---|---|
| 4,443,690 | A * | 4/1984 | Payne et al. | 219/506 |
| 4,518,850 | A * | 5/1985 | Grasso | 219/505 |
| 5,162,636 | A * | 11/1992 | Randolph et al. | 219/445.1 |
| 6,057,529 | A * | 5/2000 | Kirby | 219/445.1 |
| 2006/0027564 | A1 * | 2/2006 | Wilde et al. | 219/492 |

* cited by examiner

*Primary Examiner*—Mark Paschall
(74) *Attorney, Agent, or Firm*—Ira S. Dorman

(57) ABSTRACT

An electric cooking assembly includes a cooking surface having supported under the surface an electric heater incorporating an electric heating element and a temperature limiter including a thermally responsive assembly incorporating only a single switch, the switch being adapted to open at a predetermined sensed temperature. A control is provided, adapted to energise the electric heater from a power supply through the switch of the temperature limiter. A modular electronic monitoring device is provided, separate from the control, adapted to monitor energising of the electric heater and to activate a signal device when the cooking surface is too hot to touch.

13 Claims, 2 Drawing Sheets

ELECTRIC COOKING ASSEMBLY WITH HOT-WARNING INDICATOR

BACKGROUND OF THE INVENTION

This invention relates to an electric cooking assembly in which a cooking surface, such as of glass-ceramic, has supported thereunder at least one electric heater incorporating at least one electric heating element. The at least one electric heater also incorporates a temperature limiter comprising a thermally responsive assembly, such as a differentially thermally expanding rod and tube assembly, adapted to operate switch means associated therewith.

It is known to provide such an electric cooking assembly in which the temperature limiter is provided with first and second switch means associated therewith, the first switch means being connected in series with the at least one electric heater and a power supply, a control means also being included whereby the power of the at least one electric heater is able to be controlled. At a predetermined temperature sensed by the temperature limiter, the first switch means is caused to open to de-energise the at least one electric heater and so as to prevent overheating of and damage to the cooking surface, particularly of glass-ceramic material. The second switch means associated with the temperature limiter is initially open and is caused to be closed at a relatively low temperature to activate a warning signal means, such as a warning light, to indicate to a user that the cooking surface is too hot to touch. The provision of a temperature limiter with two sets of switch means is expensive to implement.

This problem has been overcome to some extent with the introduction of electronic power control means for glass-ceramic cooking appliances. It has been proposed to provide a hot warning light by incorporating an electronic timer within the electronic power control circuitry to trigger the hot warning light. Such an arrangement is described in GB-A-2 114 317 and eliminates the need for providing a temperature limiter with two switch means. The hot warning function is effected either by a simple timer, which is related to the power-on time, or can take into account the actual power level while one or more heaters are energised to provide an accurate simulation of the temperature profile of the cooking surface.

This arrangement of the prior art is disadvantageous in that the circuit components of the hot warning arrangement are integrated with the electronic control means for the heater and are therefore dedicated thereto. Electronic controls are also relatively expensive, particularly where additional functions are provided. Requirements therefore exist for providing a hot warning arrangement which can be used with a temperature limiter having only one switch means, such switch means being for heater control, and which can be applied not only to simple electronic power controllers but also to electromechanical power controllers such as energy regulators with rotary knob operating means.

OBJECT OF THE INVENTION

It is an object of the present invention to minimise or overcome these problems.

SUMMARY OF THE INVENTION

According to the present invention there is provided an electric cooking assembly comprising: a cooking surface having supported thereunder at least one electric heater incorporating at least one electric heating element and a temperature limiter comprising a thermally responsive assembly incorporating a single switch means, the switch means being adapted to open at a predetermined sensed temperature; control means adapted to energise the at least one electric heater from a power supply through the switch means of the temperature limiter; and modular monitoring means, separate from the control means, adapted to monitor energising of the at least one electric heater and to activate a signal means when the cooking surface is too hot to touch.

Thus the present invention provides an electric cooking assembly having a cooking surface and a thermally responsive assembly having only a single switch means which is adapted to open at a predetermined sensed temperature, such as substantially the maximum safe operating temperature of the cooking surface.

The signal means may comprise a warning light.

The signal means may be provided at a location selected from a location incorporated in the modular electronic monitoring means and a location remote from the modular electronic monitoring means.

The modular electronic monitoring means may be electrically connected to the power supply and to the at least one electric heater.

The modular electronic monitoring means may comprise input timer means, adapted to monitor energising time of the at least one electric heater, and associated output timer means adapted to activate the signal means for a predetermined time period dependant upon the energising time monitored by the input timer means.

The output timer means may be adapted to continue to activate the signal means for a predetermined time period after cessation of energising of the at least one electric heater and until the cooking surface has cooled to a temperature at which it is safe to touch.

The output timer means may be adapted to activate the signal means by way of a switch means, which may be a solid-state switch means.

The input timer means and the output timer means may be incorporated in a microprocessor.

The modular electronic monitoring means may be adapted to activate the signal means after a predetermined time period of energising of the at least one electric heater.

The modular electronic monitoring means may be adapted to activate the signal means for a time period of length dependant upon length of a time period of energising of the at least one electric heater.

The modular electronic monitoring means may additionally be adapted to monitor power of the at least one electric heater.

The control means may be selected from electronic control means and electromechanical control means.

The modular electronic monitoring means may be incorporated with an electronic control arrangement adapted to provide a control function other than for the at least one electric heater. Such control function may be for one or more electric heaters in an oven of an appliance associated with the electric cooking assembly.

The thermally responsive assembly of the temperature limiter may comprise a differentially thermally expanding rod and tube assembly adapted to operate the single switch means. Alternatively, the thermally responsive assembly of the temperature limiter may comprise a bimetallic member adapted to operate the single switch means.

The cooking surface may comprise a glass-ceramic cooking surface.

DETAILED DESCRIPTION OF THE PREFERRED EMBODIMENT

Figure 1:
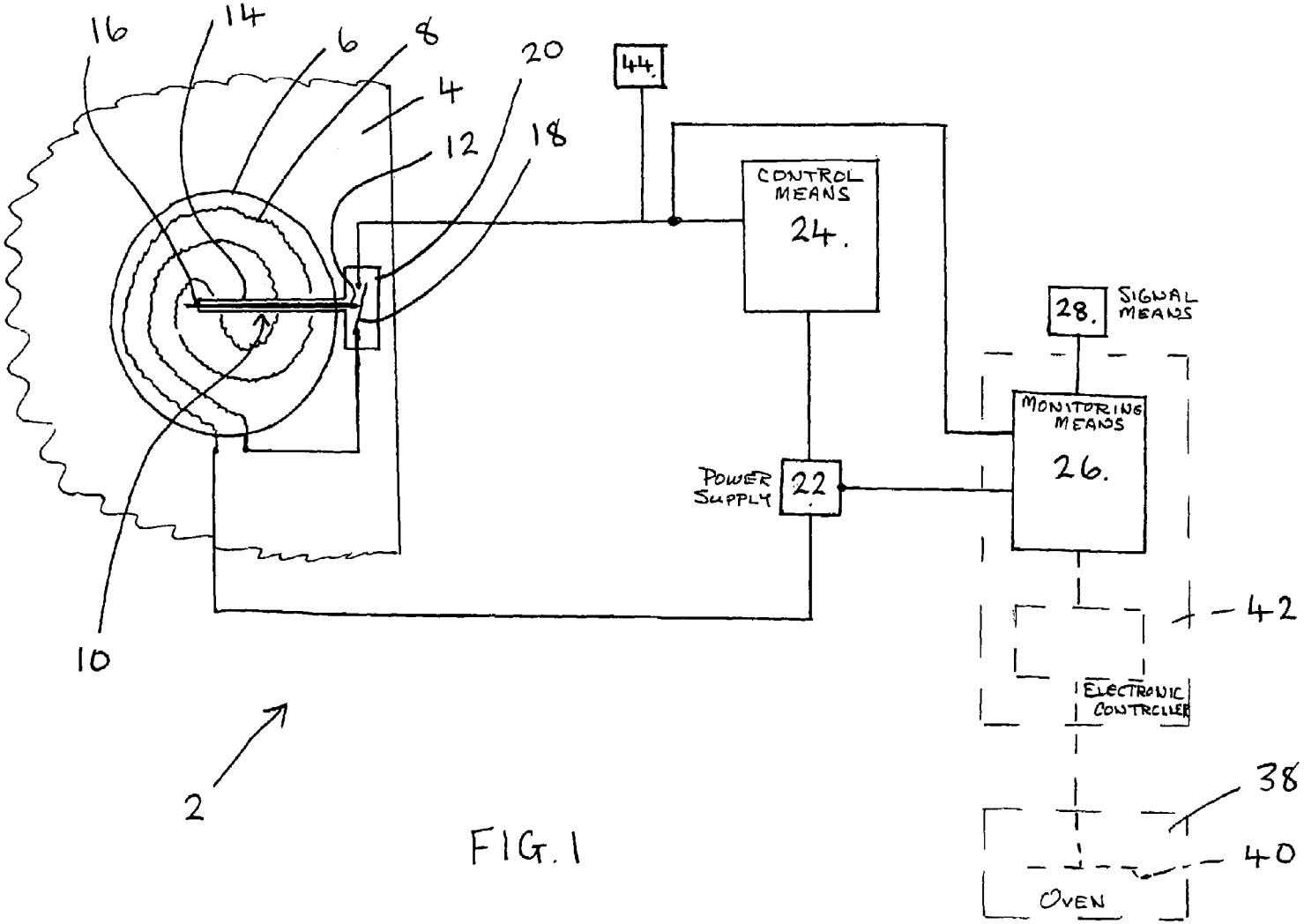
FIG. 1 is a schematic representation of an embodiment of an electric cooking assembly according to the present invention.

Referring to FIG. 1, an electric cooking assembly 2 comprises a cooking surface 4, such as of glass-ceramic material, arranged to receive a cooking utensil (not shown). Supported under the cooking surface 4 is at least one electric heater in the form of aradiant electric heater 6 incorporating at least one electric heating element 8. The or each radiant electric heater 6 is provided with a temperature limiter 10 of known form, having a thermally responsive assembly comprising a differentially thermally expanding assembly of a rod 12 inside a tube 14. The rod 12 is secured to the tube 14 at a distal end region 16. An opposite end region of the rod 12 is arranged to operate on a single switch means 18, of snap-switch form, in a housing 20. The temperature limiter 10 operates in such a way that the rod and tube assembly 12, 14 responds to the temperature particularly of the cooking surface 4, the temperature limiter 10 being calibrated in known manner such that when a predetermined limit temperature is reached, the switch means is opened.

Although not shown it is well known the employ a bimetallic member, such as a bimetallic snap disc, as an alternative to the rod and tube assembly.

A power supply 22 is electrically connected to the at least one electric heating element 8 of the at least one radiant electric heater 6 by way of a control means 24 and the switch means 18 of the temperature limiter 10. The control means 24 is adapted to control energising of the heater 6 in a required manner and with a desired power and may be an appropriately programmed electronic control means, suitably incorporating a microprocessor, or may be an electromechanical control means, such as an energy regulator, adapted for manual adjustment to provide a plurality of user-selected power levels for the radiant electric heater or heaters 6.

When a radiant electric heater 6 is energised, if the temperature sensed by the temperature limiter 10 reaches a predetermined upper limit value the switch means 18 is caused to open, resulting in disconnection of the radiant electric heater 6 from the power supply 22. Such predetermined upper limit value of temperature may be arranged to be substantially the maximum safe operating temperature of the cooking surface 4 and operation of the temperature limiter 10 to open the switch means 18 ensures that thermal damage to the cooking surface 4 does not occur. This is particularly important when the cooking surface 4 comprises glass-ceramic material.

It is common practice, for safety reasons, to provide such surface cooking appliances with one or more signal means, such as a warning light, to warn a user when a heated cooking surface is too hot to be safe to touch. This has hitherto been implemented by providing a temperature limiter similar to the temperature limiter 10, but having a second switch means incorporated therein in addition to the switch means 18. Such second switch means is used to activate a warning light when the temperature limiter is exposed to a predetermined temperature of the cooking surface at which the cooking surface would be unsafe to touch. However, the provision of the second switch means considerably adds to the complexity and cost of the temperature limiter.

It has also been proposed to provide electronic control means for a cooking assembly, such as fulfilling the function of the control means 24 when in electronic control form, in which electronic circuitry is incorporated to monitor operation of a radiant electric heater under a cooking surface using timing circuitry, and to activate a warning light after a predetermined period of energising of the heater and for a predetermined period thereafter, to warn a user that the cooking surface is too hot to touch. However, such an arrangement ties the warning light circuitry to a particular electronic control means and problems arise when other forms of control means are required to be used. Such other forms of control means may be of electromechanical form, such as energy regulators adapted for manual adjustment.

In the present invention, a modular electronic monitoring means 26 is provided, separate from the control means 24, for monitoring energising of the at least one radiant electric heater 6 and for activating a signal means 28, particularly a warning light, when the cooking surface 4 is too hot to touch. The separate modular electronic monitoring means 26 is versatile and independent of the control means 24. It is readily added to the cooking assembly 2 regardless of whether the control means 24 is of electronic or electromechanical form.

Figure 2:
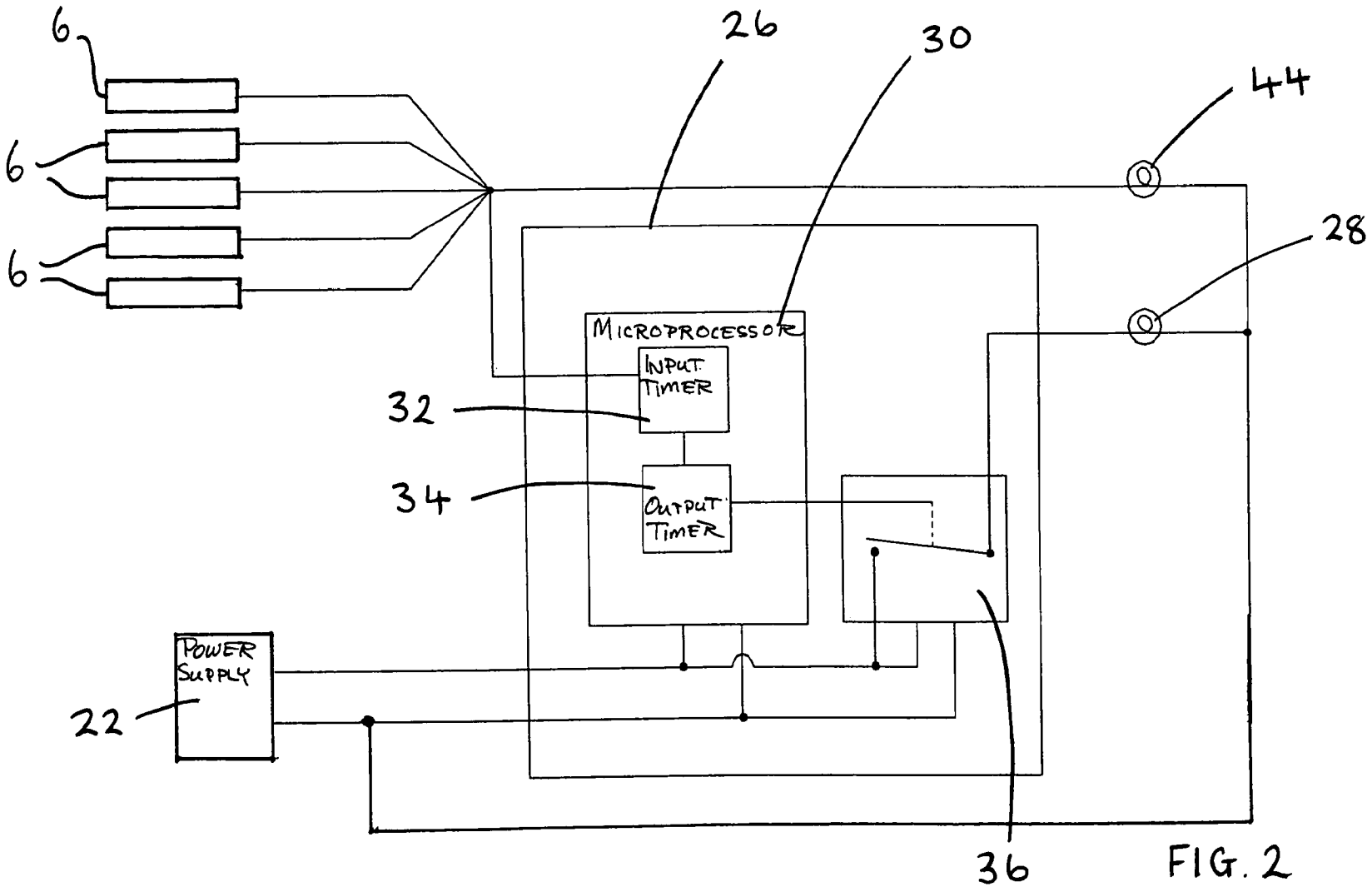
FIG. 2 is a schematic representation of an embodiment of a modular electronic monitoring means for use in the electric cooking assembly of FIG. 1.

The modular electronic monitoring means 26 is shown in detail in FIG. 2 and is electrically connected to the power supply 22 and to the one or more radiant electric heaters 6.

The modular electronic monitoring means 26 comprises a microprocessor 30 incorporating an input timer 32 and an associated output timer 34. The input timer 32 is adapted to monitor energising time of the radiant electric heater or heaters 6 and the output timer 34 is adapted to activate the warning light signal means 28, through a switch 36, such as of solid-state form, for a predetermined time period dependant upon the energising time monitored by the input timer 32. If a radiant electric heater 6 is energised for less than a predetermined threshold time period, the warning light signal means 28 is not caused to be activated by the modular electronic monitoring means 26. The output timer 34 activates the warning light signal means 28 for such predetermined period of time as to provide that the warning light signal means 28 remains activated long enough to ensure that it is only deactivated when the cooking surface 4 has cooled to a temperature at which it is safe to be touched. The output timer 34 is adapted to continue to activate the warning light signal means 28 for a predetermined time period after cessation of energising of the radiant electric heater 6, until the cooking surface 4 has cooled to a safe temperature for it to be touched.

The modular electronic monitoring means 26 is suitably adapted to activate the warning light signal means 28 for a time period of length dependant upon the length of a time period of energising of the radiant electric heater 6.

The modular electronic monitoring means 26 may additionally be adapted to monitor power of the radiant electric heater or heaters 6 and to provided compensation in the input and output timers 32, 34 to take account of the power level and to appropriately adjust the "on" time of the warning light signal means 28.

The warning light signal means 28 can be incorporated in the modular electronic monitoring means 26 or can be provided at a remote location, such as at, in or below the cooking surface 4.

The cooking assembly 2 may form part of a cooking range, which may include, in addition to the surface cooker, an oven 38 having one or more electric heaters 40 whose temperature and/or time is controlled by an electronic controller 42. In this case, the modular electronic monitoring means 26 could be incorporated in the electronic controller 42 of the oven, but would remain separate from the control means 24 for the heaters 6 of the surface cooker. This arrangement is useful where the control means 24 of the surface cooker is an electromechanical control means.

The cooking assembly 2 may incorporate a pilot light 44 to indicate when the assembly is energised.

We claim:

1. An electric cooking assembly comprising: a cooking surface having supported thereunder at least one electric heater incorporating at least one electric heating element and a temperature limiter comprising a thermally responsive assembly incorporating a single switch means, the switch means being adapted to open at a predetermined sensed temperature; control means adapted to energise the at least one electric heater from a power supply through the switch means of the temperature limiter; and modular electronic monitoring means, separate from the control means, adapted to monitor energising of the at least one electric heater and to activate a signal means when the cooking surface is too hot to touch, the electronic monitoring means comprising input timer means, adapted to monitor energising of the at least one electric heater, and associated output timer means adapted to activate the signal means for a predetermined time period dependent solely upon the energising time of the at least one heater monitored by the input timer means.

2. The assembly of claim 1, wherein the signal means comprises a warning light.

3. The assembly of claim 1, wherein the signal means is provided at a location selected from a location incorporated in the modular electronic monitoring means and a location remote from the modular electronic monitoring means.

4. The assembly of claim 1, wherein the modular electronic monitoring means is electrically connected to the power supply and to the at least one electric heater.

5. The assembly of claim 1, wherein the output timer means is adapted to activate the signal means by way of a switch means.

6. The assembly of claim 5, wherein the switch means is a solid-state switch means.

7. The assembly of claim 1, wherein the input timer means and the output timer means are incorporated in a microprocessor.

8. The assembly of claim 1, wherein the control means is selected from electronic control means and electromechanical control means.

9. The assembly of claim 1, wherein the modular electronic monitoring means is incorporated with an electronic control arrangement adapted to provide a control function other than for the at least one electric heater.

10. The assembly of claim 9 wherein the control function is for one or more electric heaters in an oven of an appliance associated with the electric cooking assembly.

11. The assembly of claim 1, wherein the thermally responsive assembly of the temperature limiter comprises a differentially thermally expanding rod and tube assembly adapted to operate the single switch means.

12. The assembly of claim 1, wherein the thermally responsive assembly of the temperature limiter comprises a bimetallic member adapted to operate the single switch means.

13. The assembly of claim 1, wherein the cooking surface comprises a glass-ceramic cooking surface.

* * * * *